US006742624B2

(12) United States Patent
DiCarlo

(10) Patent No.: US 6,742,624 B2
(45) Date of Patent: Jun. 1, 2004

(54) RAILROAD RAIL LUBRICATING APPARATUS

(75) Inventor: Leonard J. DiCarlo, St. Louis, MO (US)

(73) Assignee: Lincoln Industrial Corporation, St. Louis, MI (US)

( * ) Notice: Subject to any disclaimer, the term of this patent is extended or adjusted under 35 U.S.C. 154(b) by 0 days.

(21) Appl. No.: 10/059,718

(22) Filed: Jan. 29, 2002

(65) Prior Publication Data

US 2003/0141148 A1 Jul. 31, 2003

(51) Int. Cl.[7] ..... B61K 3/00
(52) U.S. Cl. ..... 184/3.1; 104/279
(58) Field of Search ..... 184/3.1; 104/279; 198/500; 238/338

(56) References Cited

U.S. PATENT DOCUMENTS

| | | | |
|---|---|---|---|
| 1,880,672 | A | 10/1932 | Bates et al. |
| 1,940,527 | A | 12/1933 | Bolt |
| 2,152,696 | A | 4/1939 | Huck |
| 2,489,182 | A | 11/1949 | Huck |
| 3,059,724 | A | 10/1962 | Soule, Jr. |
| 4,088,078 | A | 5/1978 | Noble |
| 4,186,821 | A | 2/1980 | Wegmann |
| 4,811,818 | A | 3/1989 | Jamison |
| 5,054,582 | A | 10/1991 | Aracil |
| 5,076,396 | A | 12/1991 | Foote |
| 5,348,120 | A | 9/1994 | Junk et al. |
| 5,394,958 | A | 3/1995 | Junk et al. |
| 5,497,852 | A | 3/1996 | Little et al. |
| 5,518,085 | A | 5/1996 | Houser, Jr. et al. |
| 5,641,037 | A | 6/1997 | Wise et al. |
| 5,687,814 | A | 11/1997 | Craig et al. |

FOREIGN PATENT DOCUMENTS

| | | |
|---|---|---|
| DE | 921 946 | 1/1995 |
| FR | 1108792 | 1/1956 |
| FR | 1333636 | 6/1963 |
| GB | 718398 | 11/1954 |
| GB | 2267937 A | 12/1993 |
| WO | WO 00/61418 | 10/2000 |

OTHER PUBLICATIONS

R. P. REIFF; "Acceptance tests for AAR Lubrication Research Vehicle"; *Lubrication Engineering;* Apr. 1987; vol. 43, pp. 266–272.
Portec Rail Products, Inc., Product Flyer: "Hydraulic Wayside Lubrication System" Jan. 1998.
Richard P. Reiff and Scott Gage; "Lubrication: How much is enough?"; *Railway Age*; May 1999; pp. 59–60.
Portec Rail Products, Inc., Product Flyer: "MC® Series Mechanical Wayside Lubrication System," Jan. 1998.
Portec Rail Products, Inc., Product Flyer: "Protector® II Electronic Rail Lubricator,"Sep. 1993.
Manual: Section III—"Rail Wear & Lubrication," Undated but Admitted Prior Art; pp. 29–36.
KLS Lubriquip, Inc., IDEX Corporation: "Trackmaster Rte 25 Rail Flange Lubricator" Jan. 1996.
Portec Rail Products, Inc., Product Flyer: "Trackside Lubricant Applicators," Jan. 1998.

*Primary Examiner*—Chong H. Kim
(74) *Attorney, Agent, or Firm*—Senniger, Powers, Leavitt & Roedel

(57) ABSTRACT

A wiper bar for application to a rail of a railroad track for applying lubricant to the head of the rail having a series of lubricant outlets and a rubber or the like guide or brush for confronting the gage face of the rail head and guiding lubricant discharged from the outlets up on the gage face, and the wiper bar/rail installation.

33 Claims, 12 Drawing Sheets

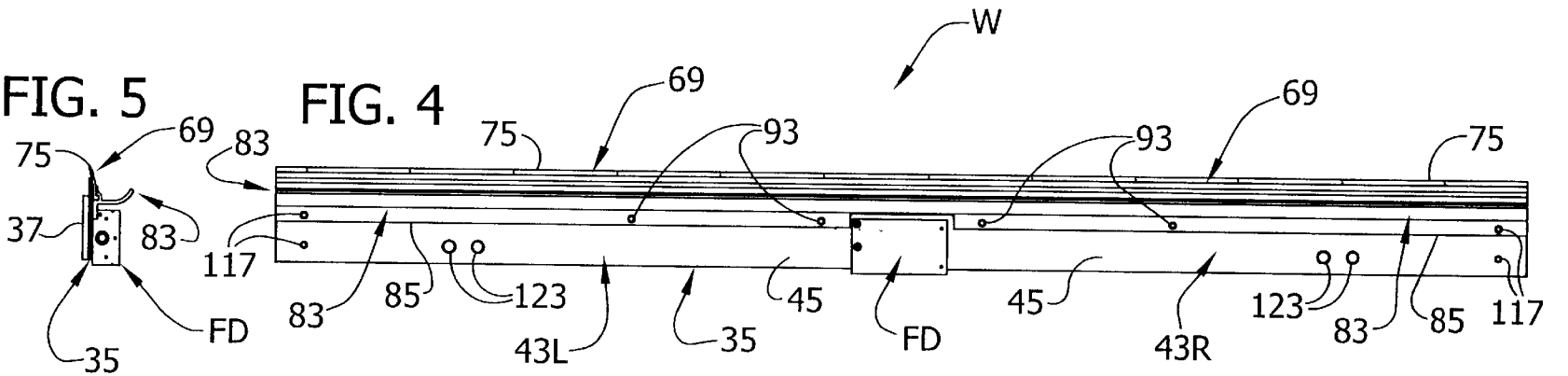
FIG. 4
FIG. 5
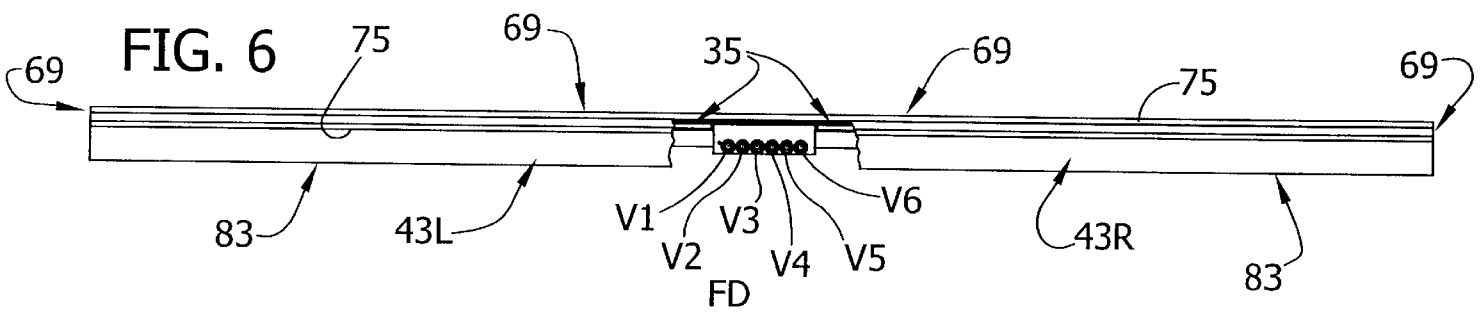
FIG. 6

RAILROAD RAIL LUBRICATING APPARATUS

BACKGROUND OF THE INVENTION

This invention relates to apparatus for applying lubricant to a rail of a railroad track, and more particularly to what is referred to in the art as a wiper bar, viz. an applicator for mounting on a rail for application of lubricant thereto as, for example, in a so-called wayside lubrication system, and to the assembly of the wiper bar and rail.

Reference may be made to U.S. Pat. Nos. 5,348,120 and 5,394,958 for a dissertation on rail lubrication and disclosure of rail lubrication systems and wiper bars used therein.

The present invention has been developed as an improvement over the wiper bar or applicator and its assembly with a rail involved in the co-assigned pending utility U.S. Patent Application of Thomas M. Arens, David C. Beck, Paul G. Conley, Ayzik Grach and Fred Leers Ser. No. 09/961,706 entitled Railroad Track Lubrication and Monitoring Thereof, which is based on Provisional Application Serial No. 60/287,587, filed Sep. 22, 2000, and incorporated herein by reference. It may also be regarded as an improvement on the wiper bar and the bar/rail assembly of the U.S. patents noted above. While the applicator (wiper bar) of the aforesaid co-assigned utility and provisional application and the bar/rail assembly thereof has been generally satisfactory, it has been determined that the wiper bar is subject to the problem of being damaged or destroyed. if the rail on which it is used is worn down or if it is subject to the passage of railroad vehicle wheels with relatively long flanges (flanges which are wider due to wheel wear). In some instances, wheel flanges are as much as one-half inch longer than the flanges on new wheels and have more flattened sides instead of sides at a 10° angle such as characteristic of the flanges of new wheels.

BRIEF SUMMARY OF THE INVENTION

Among the several objects of the invention may be noted the provision of an improved wiper bar and wiper bar and rail assembly resistant to destruction and/or damage due to a worn-down condition of the rail of the railroad track on which the wiper bar is used and/or due to passage of a railroad vehicle having worn-down wheels with prolonged flanges, or flanges with flattened sides, due to wear; the provision of a wiper bar and wiper bar and rail assembly having a manifold which has multiple lubricant outlets for delivery of lubricant for lubricating the rail head and which is resistant to crushing closed of the outlets on account of the conditions noted; and the provision of such a wiper bar and wiper bar/rail assembly of relatively economical construction, relatively economical to install, and relatively long-lived.

In general, the wiper bar of the invention comprises a wiper bar for application to a rail of a railroad track in a system for applying lubricant to the head of the rail. The wiper bar comprises an elongate manifold having inside and outside faces. A plurality of lubricant outlets are spaced at intervals along the length of the manifold for discharge of lubricant at said intervals. The manifold is passaged for flow of lubricant to the outlets. An elongate guide extends up above the manifold for confronting the gage face of the head of a rail and guiding lubricant discharged from the outlets up between said guide and gage face.

The wiper bar/rail assembly of the invention generally comprises a wiper bar as set forth in the previous paragraph mounted on a rail extending lengthwise of the rail alongside the web of the rail adjacent the gage face of the rail.

Other objects and features will be in part apparent and in part pointed out hereinafter.

BRIEF DESCRIPTION OF THE DRAWINGS

FIG. 4 is a view, in what may be regarded as outside elevation, of a manifold/mounting bar assembly of the wiper bar of this invention;

FIG. 5 is an end view of FIG. 4 (the left end);

FIG. 6 is a view in plan of FIG. 5, broken away in part;

Corresponding reference characters indicate corresponding parts throughout the several views of the drawings.

DETAILED DESCRIPTION

Figure 1:
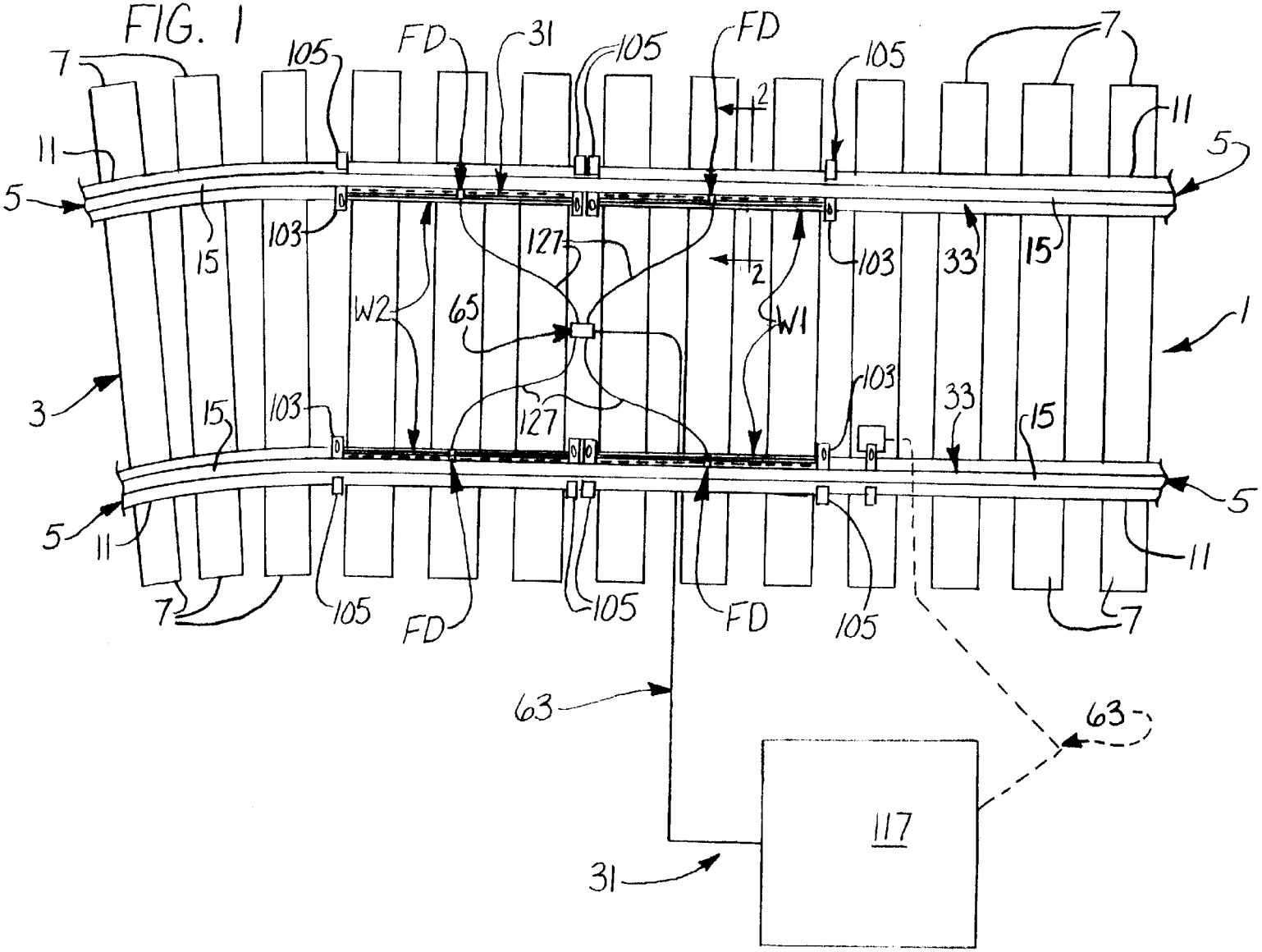
FIG. 1 is a view in plan, partly diagrammatic, of a lubrication system for lubricating, the heads of the rails of a single railroad track, embodying two wiper bars of this invention on each of the rails (four of the wiper bars in all)

Referring to the drawings, FIG. 1 shows a straight stretch 1 of railroad track leading into a curved stretch 3, the track comprising the usual railroad rails 5 fastened on the usual ties 7 laid, for example, on the usual ballast (not illustrated). Each rail is a steel rail of usual cross-section (see FIGS. 2 and 3) comprising a flange 11 fastened on the ties in the usual manner by spikes (not shown), a web 13 extending up from the flange and a head 15 on the web 13. The head has downwardly facing surfaces 17 and 19 on opposite sides of the web, generally vertical side surfaces or faces 21 and 23 extending up from the downwardly facing surfaces 17 and 19, respectively, and curved surfaces 25 and 27 extending from said side surfaces or faces 21, 23 to the top surface 29 of the head. As to each rail 5, the side face 21 of the head is on the inside, constituting its "gage face". The curved surface 25 extending around from the gage face 21 to the top surface 29 is referred to as the "gage face radius".

Referring to FIG. 1, at 31 is generally indicated a wiper bar installation or system of this invention for applying lubricant to the gage face 21 (and the gage face radius 25) of the head 15 of each rail 5 to provide lubrication between the flanges of the wheels of a train and the gage faces and gage face radii of the rails as a train negotiates the curve at 3 in order to reduce friction between the wheel flanges and the rail heads 15. In one embodiment, the installation or system 31 comprises two wiper bars of this invention extending lengthwise of each of the two rails 5 in tandem, one following the other, the first of the two being designated W1, the second W2. Each of these wiper bars W (four in all, two on one rail directly across from two on the other rail, all four being identical) is mounted on the inside 33 of the respective rail 5 for application of lubricant to the gage face 21 and gage face radius 25 of the respective rail head 15. Other installations may involve different numbers of wiper bars W (e.g., one or three or more bars per rail).

The wiper bars W being identical, a description of one of the bars on one rail will suffice for all. Thus, each one of the wiper bars W1 and W2 is shown to comprise an elongate lubricant manifold designated 35 in its entirety extending lengthwise on one face (the outside face) of a flat mounting bar 37. Bar 37 is of elongate generally rectangular shape appreciably narrower than the space between the flange 11 and the head 15 of rail 5 and of flat formation thinner than the downwardly facing surface 17 of the head 5, having inside and outside faces 39 and 41. The manifold 35 comprises two individual elongate manifold subassemblies (half-manifolds) referred to as the left-hand manifold subassembly 43L and the right-hand manifold subassembly 43R secured in tandem end-to-end on the outside face 41 of the mounting bar (see FIG. 4).

The left-hand manifold subassembly 43L comprises, in one embodiment (FIG. 3), three plates 45, 47, 49 held in laminated assembly on the left half of the outside face 41 of the mounting bar 37. Plate 45 constitutes the outside plate and plate 49 constitutes the inside plate of the three. Plate 47, which is sandwiched between plates 45 and 49, constitutes what is termed the manifold or central plate of the three. The plates are held together in laminated assembly, as by initial spot welds at 51 and subsequent furnace brazing (see FIG. 8). In one embodiment, the manifold (central) plate 47 is plated with a relatively heavy coat of a suitable brazing material such as copper. After spot welding the plates together, the assembly is heated, as in a high temperature furnace, to melt the copper plating and fuse the plates together into a pressure-tight manifold assembly. Initially, the manifold plate 47 may be formed with tabs (not shown) projecting up from its top edge to facilitate handling of the unit until the brazing process is complete, following which the tabs are preferably removed. The manifold plate 47 is wider than the outside plate 45, its upper margin 53 projecting up beyond the upper edge 55 of plate 45. The inside plate 49 preferably has substantially the same width (height) as manifold plate 37.

Figure 8:
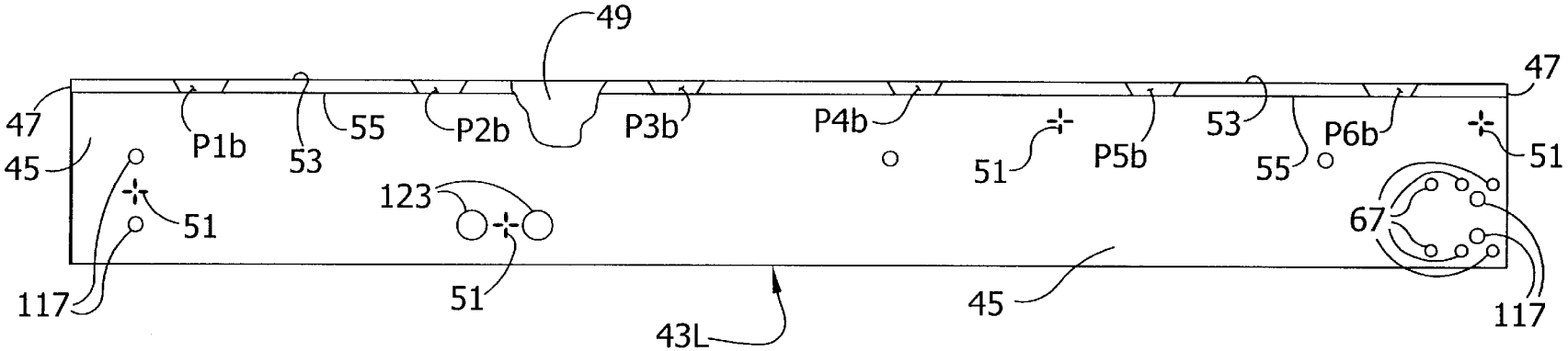
FIG. 8 is a view in elevation of a manifold subassembly (omitting certain fasteners)
Figure 9:
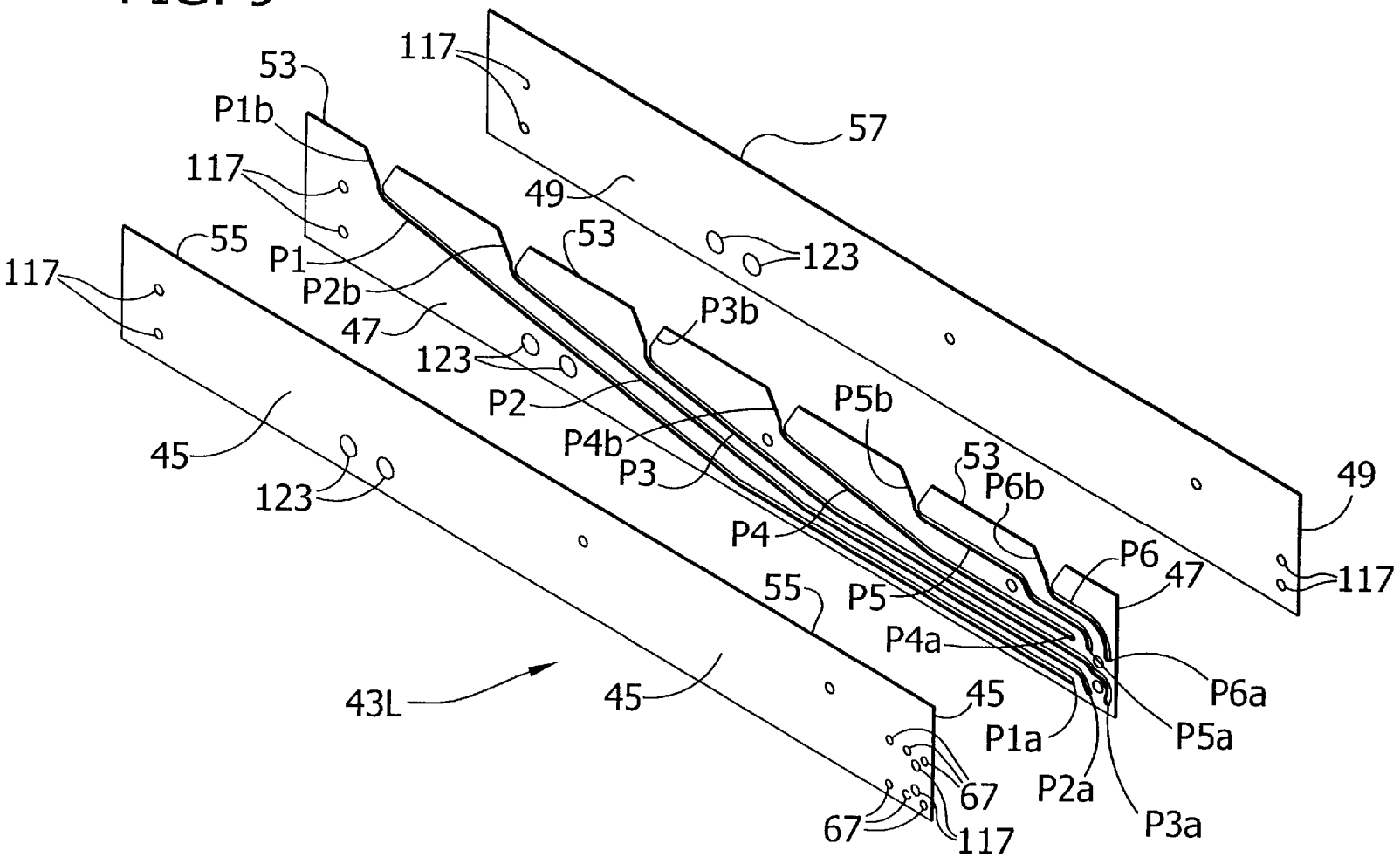
FIG. 9 is an exploded view of the FIG. 8 subassembly.

In the embodiment shown in FIGS. 8 and 9, the left-hand manifold subassembly 43L (constituting half of manifold 35) has a plurality (specifically a set of six) lubricant passages therein formed by slots in the manifold plate 47 thereof. These lubricant passages are identified by the letter P and a numeral from 1 to 6 (similarly to the identification of the passages in the aforesaid coassigned applications); thus identified as passages P1–P6. Each passage P has an inlet end designated P1*a*–P6*a*, respectively, and extends toward the left of the left-hand manifold subassembly to a triangular outlet P1*b*–P6*b*, respectively.

Referring to FIG. 9, the right-hand manifold subassembly 43R (constituting the other half of manifold 35) is similar to the left-hand manifold subassembly 43L except for being in effect reversed with respect to the above-described left-hand manifold subassembly (being in effect a mirror image of 43L). Parts of the subassembly 43R corresponding to parts of the subassembly 43L are assigned the same reference characters; however, the six passages of 43R are designated P7–P12, their inlet ends are designated P7*a*–P12*a*, and their triangular outlets are designated P7*b*–P12*b*.

Figure 5A:
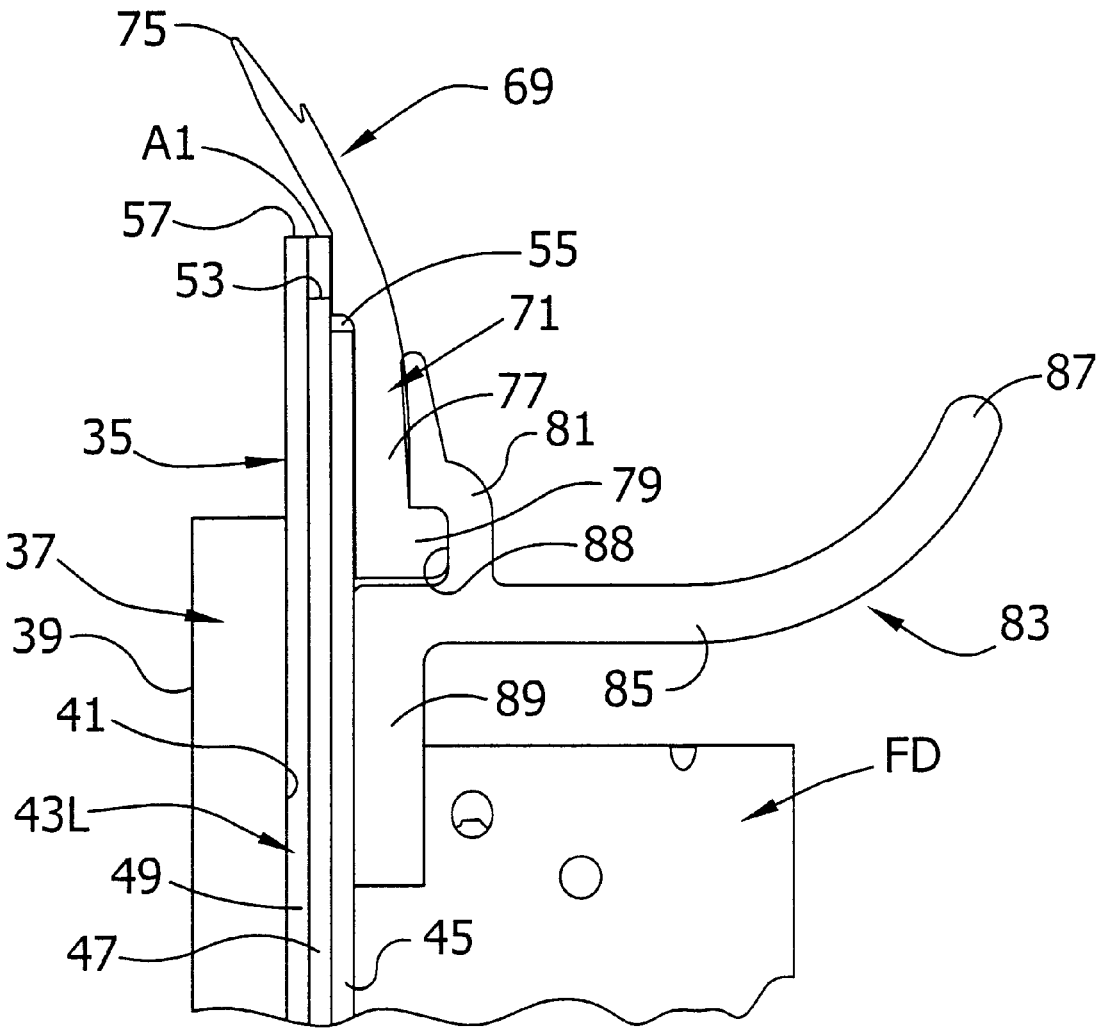
FIG. 5A is a much enlarged fragment of FIG. 5.

A lubricant flow divider designated FD in its entirety (see FIGS. 4–6) is mounted on the outside of the manifold 35, e.g., on the outside of the left-hand and right-hand plates 45 thereof at the center of length of the manifold (at the juncture of the two plates 45). The flow divider preferably comprises a plurality of divider valves, a set of six in all, indicated at V1–V6 in FIG. 6, similar to those shown in the co-assigned U.S. Pat. No. 4,186,821 of Jerome B. Wegmann issued Feb. 8, 1980 entitled Lubricating Apparatus, and co-assigned U.S. Pat. No. 5,497,852 of John Little, Jeffrey Kotyk and James B. Grove, issued Mar. 12, 1996 entitled Automatic Lubrication Apparatus, and in the aforesaid co-assigned pending application, all of which are incorporated herein by reference. Reference is made particularly to said co-assigned pending application for a disclosure of how the flow divider FD is constructed and how it operates, noting that it corresponds to the flow divider of said application except that it has six instead of nine divider valves. (The number of divider valves can vary).

Figure 10:
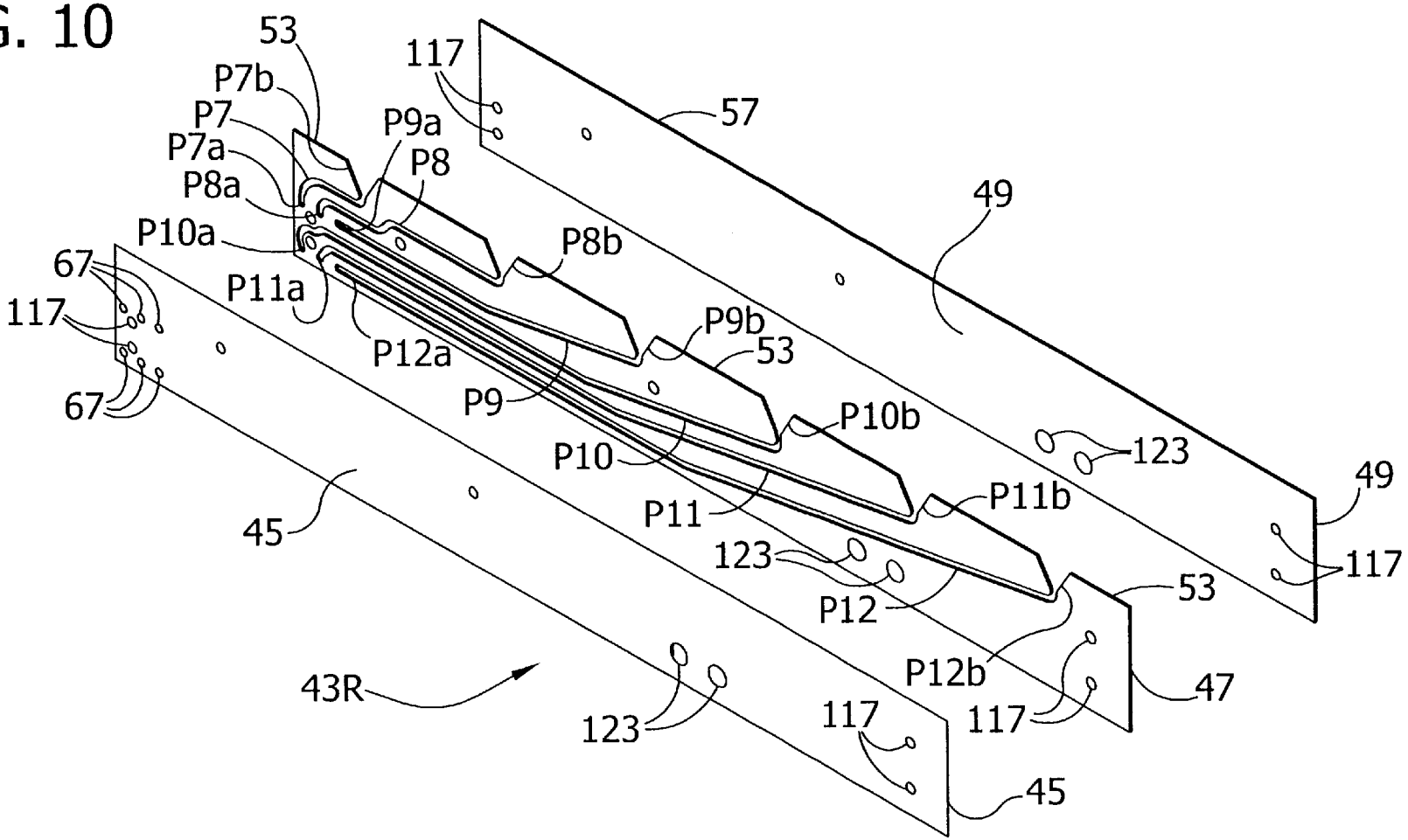
FIG. 10 is an exploded view (similar to FIG. 9) of a second manifold subassembly.

Thus, the wiper bar installation or system 31 illustrated in the drawings comprises four wiper bars, namely a W1 and a W2 on one rail, a W1 and a W2 on the other rail, each including a twelve-shot flow divider FD for dividing an input of lubricant under pressure into twelve charges, one charge for each passage P1–12. The input to each of the four wiper bars is in response to passage of a train on the track via a system indicated generally at 63 (FIG. 1) which is basically the same as that of the aforesaid co-assigned pending application. System 63 includes a four-way distributor 65 (instead of the eight-way distributor 181 of said application) supplied by a system like the system 141 of said application including a lubricant pump etc. Each flow distributor FD delivers the twelve charges of lubricant into which it divides its input through ports such as indicated at 67 (FIGS. 8–10) in the outside plates 45 of the manifold 35 on which the distributor FD is mounted to the inlet ends P1*b*–P12*b* of passages P1–P12 and through the passages P1-P12 to the outlets P1*a*–P12*a*.

Figure 3:
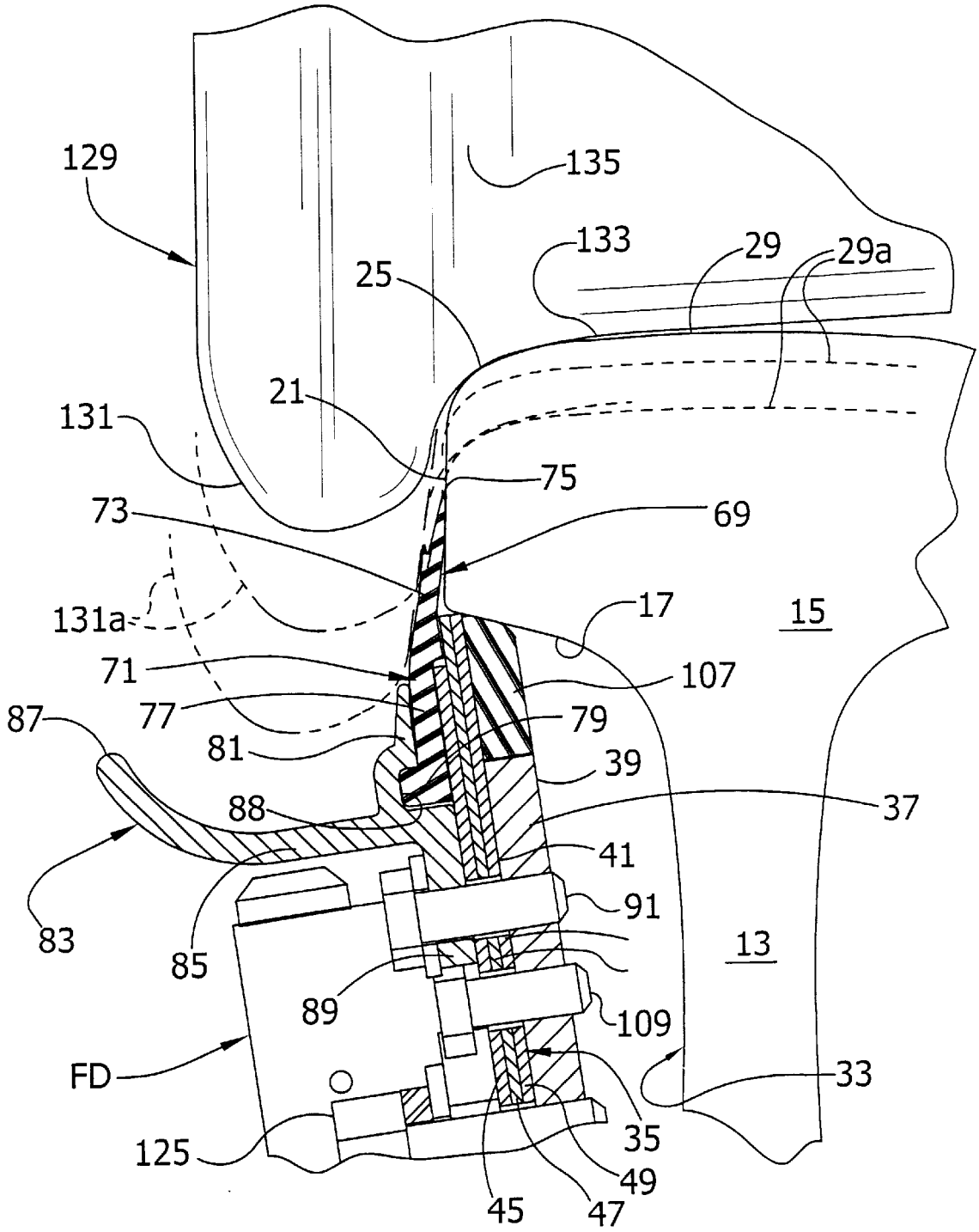
FIG. 3 is a much enlarged fragment of FIG. 2.

In accordance with this invention, each manifold 35 has an elongate guide 69 extending lengthwise generally the full length thereof (at least for the length of the series of lubricant outlets P1*b*–P12*b*). As shown in FIG. 3, the guide 69 extends up above the manifold for confronting the gage face 21 of the head 15 of a rail and guiding lubricant discharged from the outlets P1*a*–P12*a* up between the guide 69 and the gage face 21 (as will be described hereinafter). Guide 69 extends up from an elongate base generally designated 71 secured on the outside face of the manifold 35.

The guide 69 comprises a flexible and elastic blade, in essence being an elongate strip generally twice the length of one of the manifold subassemblies 43L, 43R so as to extend generally the length of the two subassemblies in tandem. (The strip can be one long piece or divided into shorter segments.) The guide 69 is made of a lubricant-resistive elastomer; rubber or plastic, for example. The guide or blade 69, in transverse cross-section, has a lower relatively wide lower section 73 tapering therefrom to its upper edge 75 (which is quite thin). The guide (blade) 69 and the base 71 are integrally formed of the flexible and elastic material (as by extrusion), the base, in effect, being an elongate strip of such cross-section as to have a web 77 surmounted by the blade, which is angled with respect to the base to extend inwardly over the upper edge of the manifold 35 in the free state of the blade (see particularly FIG. 5A). The web 77 has an outwardly extending foot 79.

The base 71 of guide 69 is clamped against the outside face of the manifold 35, extending lengthwise of the manifold 35 adjacent its upper edge, by the elongate inside wall 81 of an elongate trough generally designated 83 for catching overflow. The trough, which may be made by extrusion of a suitable plastic or of metal, has a bottom 85, an outside upwardly curved wall 87, the aforesaid wall 81 extending up from the bottom having an elongate groove 88 receiving the elongate foot 79, and a downwardly extending flange 89 secured on the outside face of the manifold as by screws 91 threaded in tapped holes 93 in the mounting bar 37.

Figure 2:
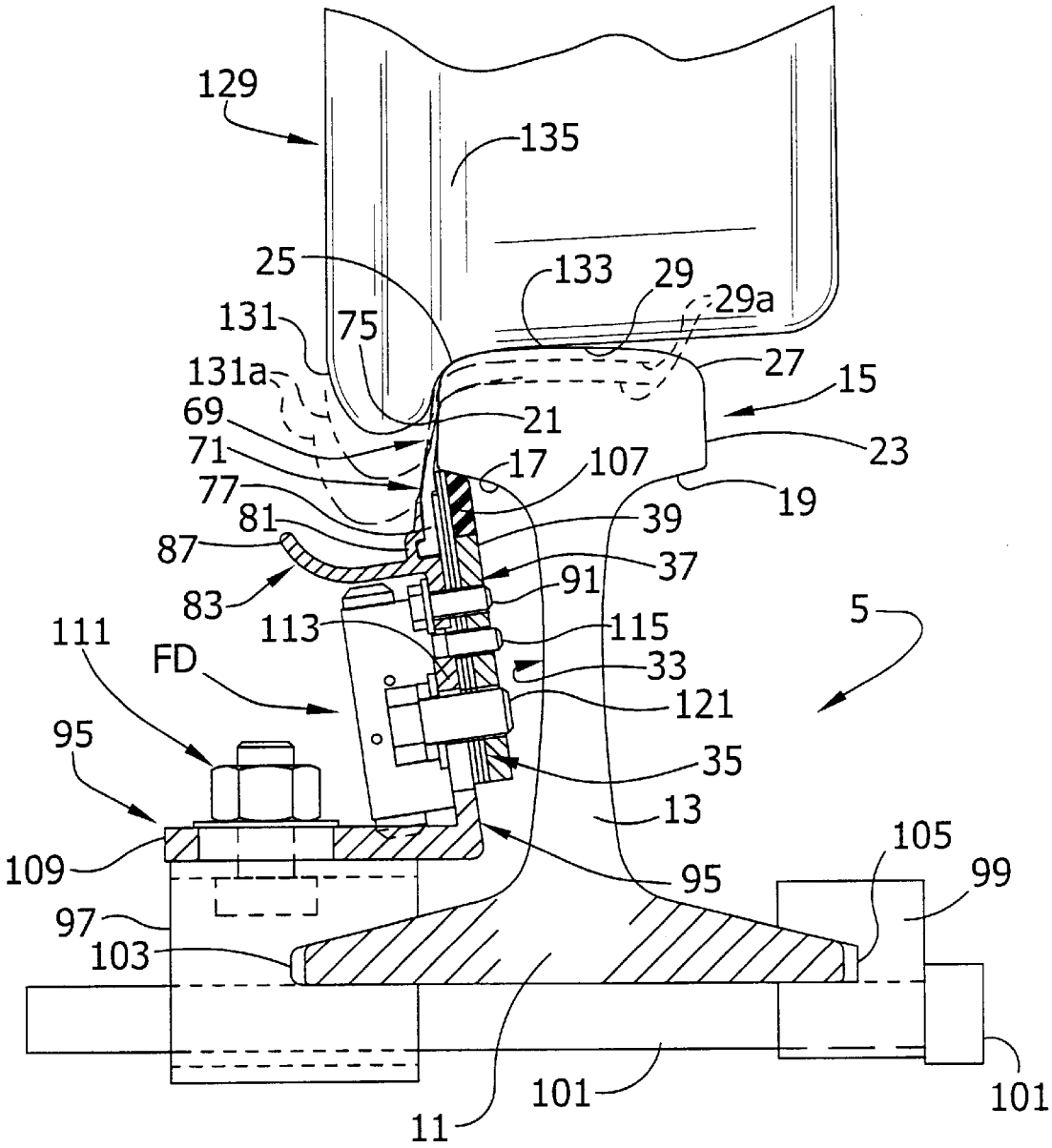
FIG. 2 is a cross-section on line 2—2 of FIG. 1 on a larger scale cross-hatching of the rail being omitted for the most part.

The wiper bar 1 is mounted on the inside of a rail 5 as best shown in FIGS. 2 and 3, having mounting means comprising a support 95 near each end of the mounting bar 37 on a first rail clamp jaw 97 engaging the inner edge of the flange 11 of the rail, in association with a second clamp jaw 99 engaging the outer edge of the flange of the rail with a clamp bolt 101 extending under the flange of the rail for drawing the jaws together for tight securement of the wiper bar to the rail including lateral securement. The mounting bar 37 is mounted on the inside of the web 13 of the rail extending lengthwise of the rail between the inside part of the rail flange 11 and the underside 17 of the rail head 15. The jaws 97 and 99 have recesses 103 and 105, respectfully, receiving the respective edges of the flange 11. An elongate seal 107 extends the length of the mounting bar 37 sealing against the underside 17 of the rail head 15 to inhibit flow of lubricant inward on the underside 17 of the rail head 15. The blade 69 is flexed outwardly and is in resilient engagement with the gage face 21 of the rail head.

Figure 7:
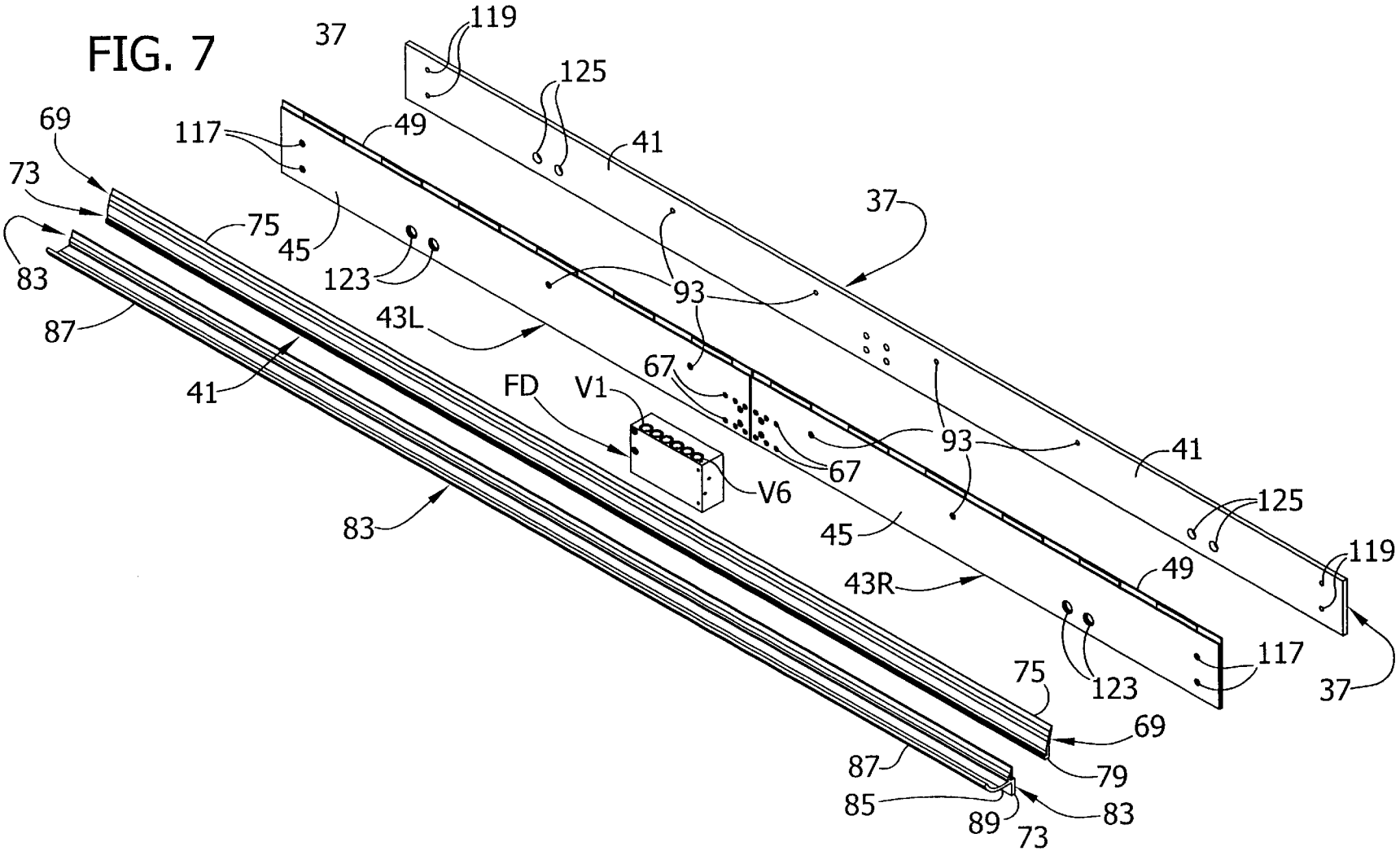
FIG. 7 is an exploded view detailing parts shown in FIG. 4.

Each mounting bar support 95 comprises a horizontal base or foot 109 which is fastened as indicated at 111 on the respective jaw 97 and a slightly outwardly inclined upwardly extending leg 113. Leg 113 extends up on the outside of the manifold 35, and the support 95 is fastened in place by screws 115 extending through holes 117 in the manifold threaded in tapped holes 119 in the mounting bar. The manifold 35 is secured on the outside of the mounting bar by screws 121 extending through holes 123 in the manifold threaded in holes 125 in the mounting bar (FIG. 7).

The flow dividers FD of each wiper bar W1, W2 are serviced in response to passage of a train on the track by the above-noted system indicated in its entirety by the reference numeral 63 (the same system as generally indicated at 141 in the aforesaid pending application), including a pump for pumping lubricant from a supply in response to passage of a train to the distributor 65 (corresponding to master distributor 181 of said application) which serves to divide the input of lubricant into four equal deliveries via lines indicated at 127 (corresponding to lines 183 of said application) connected to the flow dividers FD. Each flow divider FD splits each input thereto into twelve, for example, outputs, which are fed via ports 67 into the inlets P1*a*–P12*a* of lubricant passages P1–P12. Lubricant flows from the inlets P1*a*–P12*a* of the manifold 35 through the passages P1–P12 to the twelve lubricant outlets P1*b*–P12*b* in the manifold, from which it exits away from the projecting upper margin 57 of the inside manifold plate 49 toward the blade 69, flexing the blade outwardly. The lubricant oozing out of the outlets P1*b*–P12*b* creeps up the gage face 21, being confined and guided by the blade 69, and up further on the gage face radius 25, thus providing for application of lubricant to the rail.

FIGS. 2 and 3 illustrate in solid lines a wheel 129 of a railroad vehicle (a railroad car or locomotive) riding on the rail 5 with the flange 131 of the wheel on the inside of the rail head 15 (on the inside of the gage face 21 of the rail head) before any wearing down of the top surface 29 of the rail head and/or wearing away of the tread of the wheel and resultant prolongation of the wheel flange 131. The tread of the wheel bearing down on the top surface 29 of the rail head 15 is indicated at 133. At 135 is indicated the curved transition (which extends in a circle around the wheel) from the flange 131 to the tread 133 which engages the gage face radius 25 of the rail head. The dofted lines indicated generally at 131*a* in FIGS. 2 and 3 illustrate how the flange 131 passes in engagement with the outside of the flexible elastic blade 69, at the worst squeezing the blade, without any problem of it striking hard components of the wiper bar and crushing them on wear of the rail head 15 or wear of the tread 133 prolonging the flange 131. The possibility of the outlets P1*b*–P12*b* being crushed closed is also made even more remote by reason of the outside manifold plates 45 being staggered down lower than the inside manifold plates 49. The dofted lines indicated at 29a in FIGS. 2 and 3 illustrate wear-down of the rail head.

Figure 11:
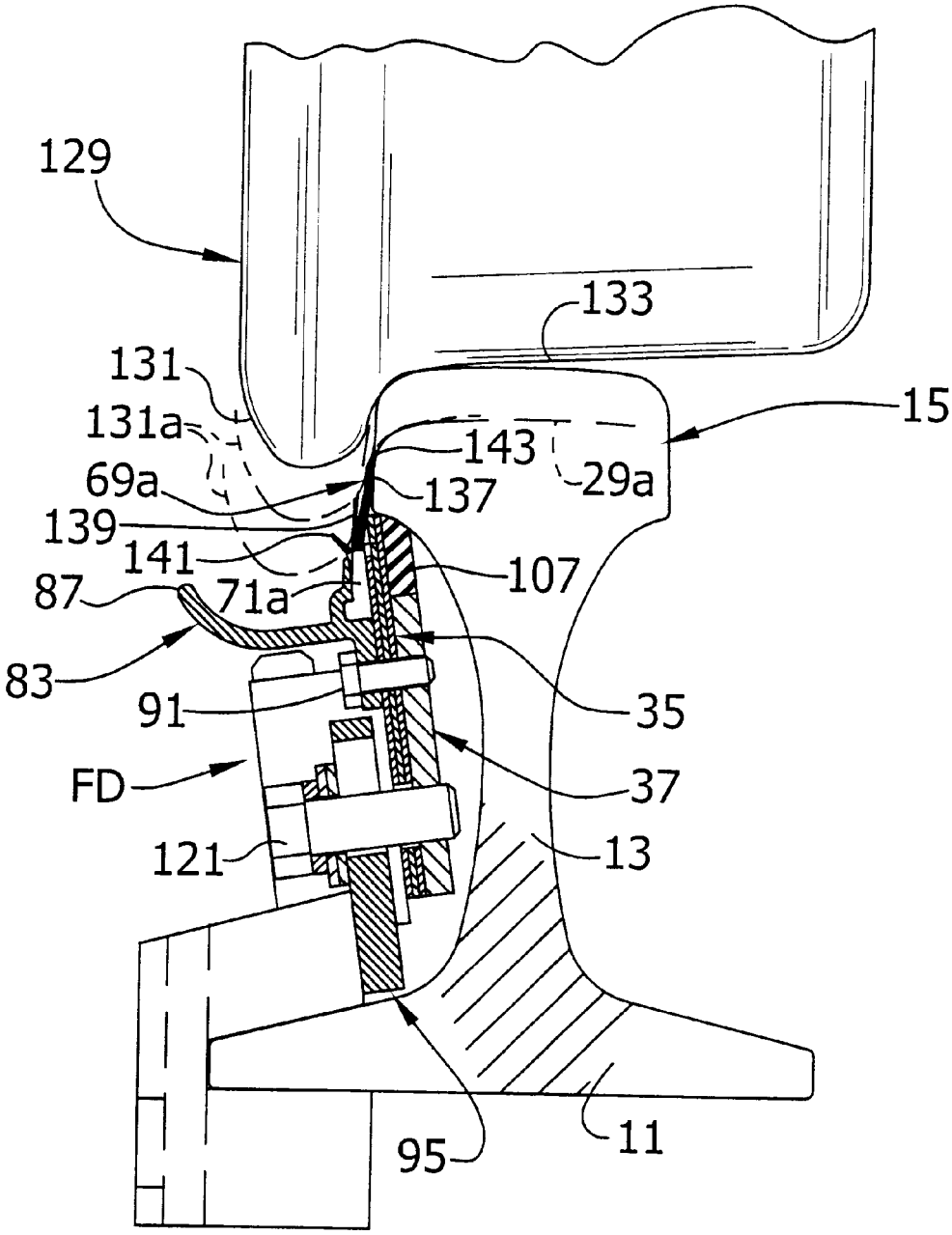
FIG. 11 is a cross-section similar to FIG. 2 showing a modification.
Figure 12:
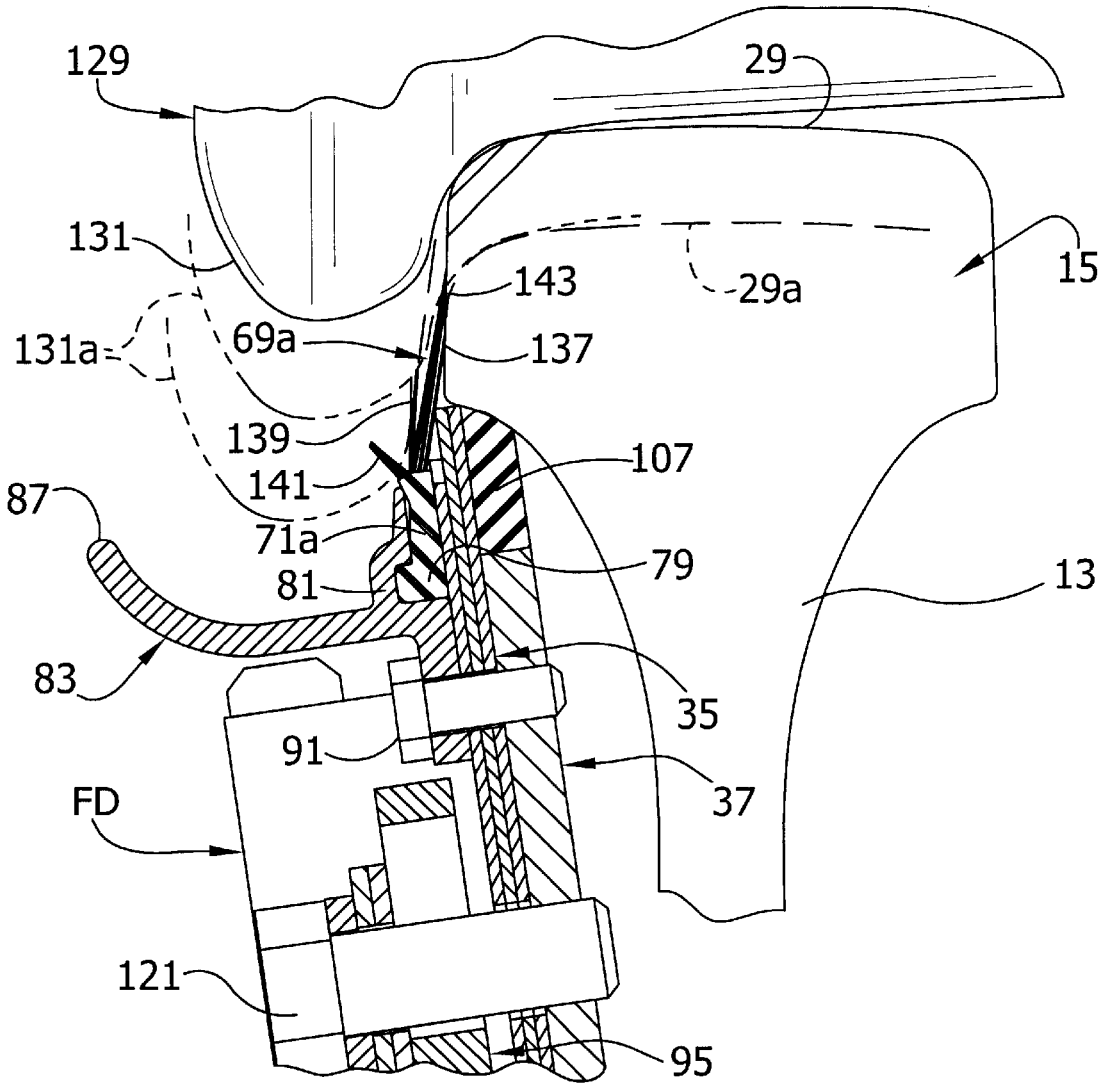
FIG. 12 is an enlarged fragment of FIG. 11.

FIGS. 11 and 12 illustrate a modification of the wiper bar W1 (or W2) of the invention which is in most respects the same as the wiper bar W1 (or W2) with the primary exception being that the guide 69 of W1 (or W2) is replaced by a guide 69*a* comprising brush bristles extending up from a base 71*a* corresponding to base 71. As illustrated, there are three rows 137,139 and 141 of bristles rooted in and extending upwardly from the base 71*a*. Row 137, constituting the primary row, extends generally upwardly from the base slanting inwardly confronting the gage face 21 of the rail head 15, the tips of the 137 bristles engaging the gage face as indicated at 143. Row 139, constituting the secondary row, extends generally upwardly from the base on the outside of row 137, being of lesser slant and height than row 137. Row 141, constituting the tertiary row, extends generally upwardly from the base 71*a* on the outside of row 139, being of lesser height than row 139 and slanting outwardly away from row 139. Row 137 functions like the blade 69. Row 139 catches lubricant that may spill over and holds it high enough to be eventually picked up by the flange of the wheel. Row 141 increases the lubricant holding capacity of the guide 69a to prevent lubricant spill-over. A combination of rubber or the like and brush bristles is contemplated. The bristles themselves can be made of any suitably flexible and resilient material, such as nylon or other plastic. Also, the configuration and number of rows of bristles may vary.

Figure 13:
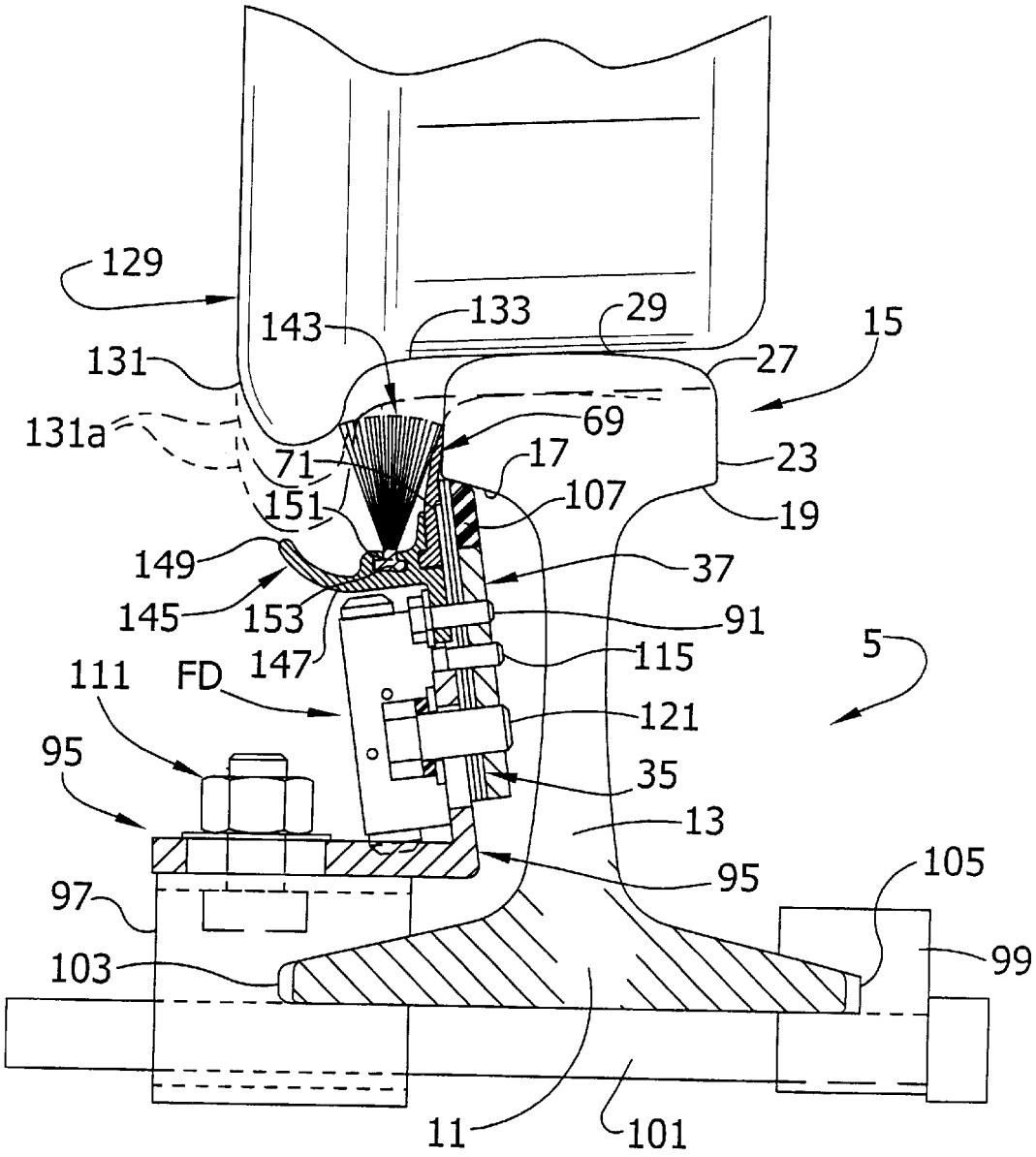
FIG. 13 is a view similar to FIG. 12 showing a further modification.

FIG. 13 illustrates a further modification constructed like the species shown in FIGS. 2–10 having the guide comprising the flexible and elastic blade 69, with the wiper bar further comprising a row 143 of brush bristles extending upwardly on the outside of the blade 69. The FIG. 13 wiper bar has trough 145 on the outside of the said base 71, the trough having bottom 147 and upwardly extending wall 149. The row of bristles 143 extends upwardly on the outside of blade 69 from an elongate base 151 secured in an elongate recess 153 in the bottom 147 of the trough. In the installation of the FIG. 13 wiper bar, the row of bristles (which fan out as shown) contacts the gage face 21 of the rail head above the upper edge 75 of the blade 69. The brush holds grease for application to the flange of a wheel even when there is a gap (e.g., a one inch gap) between the flange and the gage face.

In view of the above, it will be seen that the several objects of the invention are achieved and other advantageous results attained. It will be noted in this regard that the guide 69 of this invention provides for the efficient distribution of lubricant to the rail gage face and rail gage radius, even with the use of less viscous greases. Because the guide is thin and of resilient material, it is resistant to damage by the flanges of a wheel passing along the rail. The use of the guide allows the metal parts of the wiper bar W to be mounted substantially below the reach of the wheel flanges, thus avoiding damage to these parts as a result of wheel strike. The angled configuration of the guide 69 insures that the guide contacts the rail without undue adjustment. Further, the guide is quickly and easily replaceable in the event of wear and/or damage. The worn or damaged part is simply unclamped and replaced with a new guide. There is no need to remove the mounting bar 37 or disturb the position of the manifold 35.

As various changes could be made in the above constructions without departing from the scope of the invention, it is intended that all matter contained in the above description or shown in the accompanying drawings shall be interpreted as illustrative and not in a limiting sense.

When introducing elements of the present invention or the preferred embodiments thereof, the articles "a", "an", "the" and "said" are intended to mean that there are one or more of the elements. The terms "comprising", "including" and "having" are intended to be inclusive and mean that there may be additional elements other than the listed elements.

What is claimed is:

1. A wiper bar for application to a rail of a railroad track in a system for applying lubricant to the head of the rail, said wiper bar comprising an elongate manifold having inside and outside faces, said manifold having a plurality of lubricant outlets spaced at intervals along its length for discharge of lubricant at said intervals and being passaged for flow of lubricant to said outlets, an elongate guide extending up above the manifold for confronting the gage face of the head of a rail and guiding lubricant discharged from the outlets up between said guide and gage face, the guide being formed of a flexible and resilient material such that the guide is resistant to damage due to engagement by wheels of railroad vehicles and such that the guide inhibits wear upon said wheels, said guide extending upwardly from an elongate base secured on the outside face of the manifold, and a trough on the outside of the guide for catching excess lubricant, the trough including a bottom, a wall extending up from the bottom and securing the base against the outside face of the manifold, and a downwardly extending flange configured for securement to the manifold.

2. A wiper bar as set forth in claim 1 wherein said guide comprises a flexible and elastic blade.

3. A wiper bar as set forth in claim 1 wherein said guide comprises a brush.

4. A wiper bar as set forth in claim 1 wherein said guide and base are integrally formed.

5. A wiper bar as set forth in claim 1 wherein said guide comprises brush bristles extending up from the base.

6. A wiper bar as set forth in claim 5 wherein said brush bristles are arranged in a row of bristles which angle upward and inward over the upper margin of the manifold.

7. A wiper bar as set forth in claim 6 wherein said guide further comprises at least one row of bristles on the outside of said angled row of bristles.

8. A wiper bar as set forth in claim 1 wherein said guide comprises a blade extending upwardly from said elongate base secured on the outside face of the manifold, said blade being angled with respect to the base to extend over the upper edge margin of the manifold.

9. A wiper bar as set forth in claim 1 wherein said guide comprises an elongate row of brush bristles extending upwardly from said elongate base secured on the outside face of the manifold, said row of bristles being angled with respect to the base to extend over the upper edge margin of the manifold.

10. A wiper bar as set forth in claim 1 comprising an elongate mounting bar having opposite faces, one constituting its inside face and the other its outside face as applied extending lengthwise of a rail, said manifold being fastened on the outside face of the mounting bar and comprising a lamination of a manifold plate between an outside and an inside plate, said manifold plate having said outlets therein adjacent an upper edge thereof and being passaged for the flow of lubricant to said outlets by being slotted, said guide extending up above an upper edge of the inside plate.

11. A wiper bar as set forth in claim 10 wherein said guide comprises a blade.

12. A wiper bar as set forth in claim 10 wherein said guide comprises a brush.

13. A wiper bar as set forth in claim 10 wherein said elongate base is secured on the outside plate of the manifold.

14. A wiper bar as set forth in claim 13 wherein said guide and base are integrally formed.

15. A wiper bar as set forth in claim 13 wherein said guide comprises brush bristles extending up from the base.

16. A wiper bar as set forth in claim 10 wherein, said guide comprises a blade extending upwardly from said elongate base secured on the outside face of the manifold, said blade being angled with respect to the base to extend over the upper edge of the manifold.

17. A wiper bar as set forth in claim 10 wherein said guide comprises an elongate row of brush bristles extending upwardly from said elongate base secured on the outer face of the manifold, said row of bristles being angled with respect to the base to extend over the upper edge of the manifold.

18. A wiper bar installation for lubricating the head of a rail of a railroad track, said rail comprising a flange, a web extending up from the flange and a head on the web having downwardly facing surface portions on opposite sides of the web, side surfaces extending up from said downwardly facing surface portions, one of said side surfaces constituting the gage face of the rail, curved surfaces extending from, said side surfaces to the top surface of the head, the curved surface extending from the gage face around to the top surface constituting the gage face radius, said installation comprising a wiper bar comprising an elongate manifold having inside and outside faces and upper and lower elongate edge margins extending lengthwise of the manifold, said manifold being mounted on the rail extending lengthwise of the rail alongside the web of the rail with its upper edge margin adjacent the lower edge of the gage face, said manifold having a plurality of lubricant outlets spaced at intervals along its length for discharge of lubricant at said intervals and being passaged for flow of lubricant to said outlets, and an elongate guide extending up above the manifold for confronting the gage face of the head of a rail and guiding lubricant discharged from the outlets up between said guide and gage face, the guide being formed of a flexible and resilient material such that the guide is resistant to damage due to engagement by wheels of railroad vehicles and such that the guide inhibits wear upon said wheels, said guide extending upwardly from an elongate base secured on the outside face of the manifold, and a trough on the outside of the guide for catching excess lubricant, the trough induding a bottom, a wall extending up from the bottom and securing the base against the outside face of the manifold, and a downwardly extending flange configured for securement to the manifold.

19. A wiper bar installation as set forth in claim 18 wherein said guide comprises a blade.

20. A wiper bar installation as set forth in claim 18 wherein said guide comprises a brush.

21. A wiper bar installation as set forth in claim 18 wherein said guide and base are integrally formed.

22. A wiper bar installation as set forth in claim 18 wherein said guide comprises brush bristles extending up from the base.

23. A wiper bar installation as set forth in claim 18 wherein said guide comprises a blade extending upwardly from said elongate base secured on the outside face of the manifold, said blade being angled with respect to the base to extend over the upper edge margin of the manifold.

24. A wiper bar installation as set forth in claim 18 wherein said guide comprises an elongate row of brush bristles extending upwardly from said elongate base secure on the outside face of the manifold, said row of bristles being angled with respect to the base to extend over the upper edge margin of the manifold.

25. A wiper bar installation as set forth in claim 24 wherein said guide comprises at least one elongate row of bristles on the outside of said angled elongate row.

26. A wiper bar installation as set forth in claim 18 wherein said wiper bar comprises an elongate mounting bar mounted on the rail extending lengthwise of the rail alongside the web of the rail, said mounting bar having an inside and an outside face, said manifold being fastened on the outside face of the mounting bar and comprising a lamination of a manifold plate between an outside and an inside plate, said manifold plate having said outlets therein adjacent an upper edge thereof and being passaged for the flow of lubricant to said outlets by being slotted, said guide extending up above an upper edge of the inside plate, said guide resiliently engaging said gage face of the rail.

27. A wiper bar installation as set forth in claim 26 having a seal between the upper edge of the mounting bar and the head of the rail.

28. A wiper bar as set forth in claim 2 further comprising a row of brush bristles extending upwardly on the outside of the blade.

29. A wiper bar as set forth in claim 8 further comprising an elongate row of brush bristles extending upwardly from said elongate base secured in the bottom of the trough on the outside of the blade.

30. A wiper bar installation as set forth in claim 19 wherein the wiper bar further comprises a row of brush bristles extending upwardly on the outside of the blade, said row of bristles contacting the gage face of the head of the rail above the upper edge of the blade.

31. A wiper bar installation as set forth in claim 23 further comprising an elongate row of brush bristles extending upwardly from said elongate base secured in the bottom of the trough on the outside of the blade, said row of bristles contacting the gage face of the head of the rail above the upper edge of the blade.

32. A wiper bar as set forth in claim 1 wherein the wall of the trough extends up from the bottom and has an elongate groove for receiving a portion of the guide.

33. A wiper bar as set forth in claim 32 wherein the base has a foot for being secured in said elongate groove in the wall of the trough.

* * * * *